United States Patent [19]

Gridel

[11] 3,983,586

[45] Oct. 5, 1976

[54] RAPIDLY POSITIONED ENVELOPE COVER

[76] Inventor: Joseph Gridel, 59-St., Souplet, France

[22] Filed: May 4, 1973

[21] Appl. No.: 357,144

Related U.S. Application Data

[63] Continuation of Ser. No. 170,171, Aug. 9, 1971.

[52] U.S. Cl. ..... 5/334 C; 5/335

[51] Int. Cl.[2] ..... A47G 9/00

[58] Field of Search ..... 5/334, 334 C, 335, 343

[56] References Cited

UNITED STATES PATENTS

| | | | |
|---|---|---|---|
| 2,695,414 | 11/1954 | Ford et al. | 5/334 C |
| 2,942,280 | 6/1960 | May | 5/334 C |
| 3,530,487 | 9/1970 | Beer | 5/335 |

*Primary Examiner*—Robert L. Wolfe
*Assistant Examiner*—Andrew M. Calvert
*Attorney, Agent, or Firm*—Sughrue, Rothwell, Mion, Zinn and Macpeak

[57] ABSTRACT

A contour bed blanket and detachable sheet assembly. The blanket portion is provided with insulating filling in its top surface and has depending flaps on three of its four sides. The flaps are sewn together at two corners to define a pocket adapted to slip over and around the end of a mattress. A sheet may also be buttoned in place inside the blanket.

5 Claims, 5 Drawing Figures

INVENTOR
JOSEPH GRIDEL
BY Sughrue, Rothwell, Mion, Zinn & Macpeak
ATTORNEYS

RAPIDLY POSITIONED ENVELOPE COVER

This is a continuation of application Ser. No. 170,171, filed Aug. 9, 1971.

The present invention relates to a bed cover and more particularly to a bed cover made in the form of an envelope for its rapid positioning around a portion of the mattress.

Very many bedspreads, blankets, eiderdowns and sleeping bags are known, each characterised by the particular advantages appertaining to their special function, but none of them enables the cost and the maintenance of the bedding, and the time necessary for the making of the bed, to be simultaneously reduced, whilst also improving the comfort of the user, as compared with conventional bedding.

By way of example, eiderdowns are already known having a cover serving as a top sheet which it is only necessary to place above the sheet disposed on the mattress. These eiderdowns have the disadvantage of slipping and are more adapted to wide beds than to narrow beds. Ordinary bed clothes frequently require either the use of an eiderdown, or several blankets one upon the other.

In addition to the time spent in making the bed, the extra thickness of the edges of the blankets and sheets tucked in under the mattress causes its centre portion to curve inwardly and contributes to the loss of shape of the mattress. In fact, the user lies in the centre portion which tends to sink even more, due to the raising of the edges of the mattress. As to conventional bedspreads, they are used only for protection or to enhance the appearance of the bed. Although they are easily adaptable to the bed by virtue of their special formation designed for covering the whole or a part of the bed, they are not used for the comfort of the reclining person, since they only serve as a day-time covering of the bed with partial withdrawal at night and are consequently less effective.

The object of the present invention is a cover characterised in that it comprises a portion having special heat-insulating properties, hereinafter termed "padded", approximately equal to that of the upper surface of the mattress and three flaps of material respectively associated with each of the long sides and with one of the short sides of the padded portion, each of these flaps associated with the long sides being sewn over a portion of its length to the flap associated with one of the short sides, so that the resultant seams communicate a longitudinal traction to the said padded portion.

Such a covering has the advantage of being economical, comfortable and practical. In fact, the tension exerted on the seams results in the formation of a case, the depth of which depends only on the length of the it is associated with the short side and which is possible to reduce by at least 20 centimeters. It is therefore very easy to introduce this portion of the cover around the part of the mattress near the foot of the bed and to tuck into the sides of the bed the flaps associated with the long sides of the padded part. However, since the case is formed only by the presence of the two seams, with the exclusion of any other seam strictly limiting the depth of the case, it is possible to use the cover of the present invention on mattresses of different thicknesses. Differing from ordinary covers, the portion introduced between the mattress and the base is only of minimum thickness, so that the mattress rests on a practically plane surface and is not raised at its edges. On the other hand, the padded part is disposed, as in eiderdowns, only on the useful part, that is to say, on top of the bed, without this part being able to slip off the mattress.

Another object of the invention is a cover of this kind comprising, at the junction of the padded part and the flaps and within the resultant case, fasteners for the attachment of a sheet, the said sheet being of a width very slightly greater than the width of the padded part and of a length at least greater by 10 centimeters compared with that of the padded part, hems along the edges of the sheet receiving the said members for its attachment.

In this manner, an extremely practical and economical unit is obtained, involving an appreciable saving of time when making the bed, since it is only necessary to place the resultant cover around the portion of the mattress at the foot of the bed and merely to tuck the side folds into the mattress to obtain a bed having a neat appearance, the cover adapting itself to the shape of the mattress.

In order that the invention may be readily carried into practice, one embodiment will now be described in detail by way of example, with reference to the accompanying drawings in which.

Figure 1:
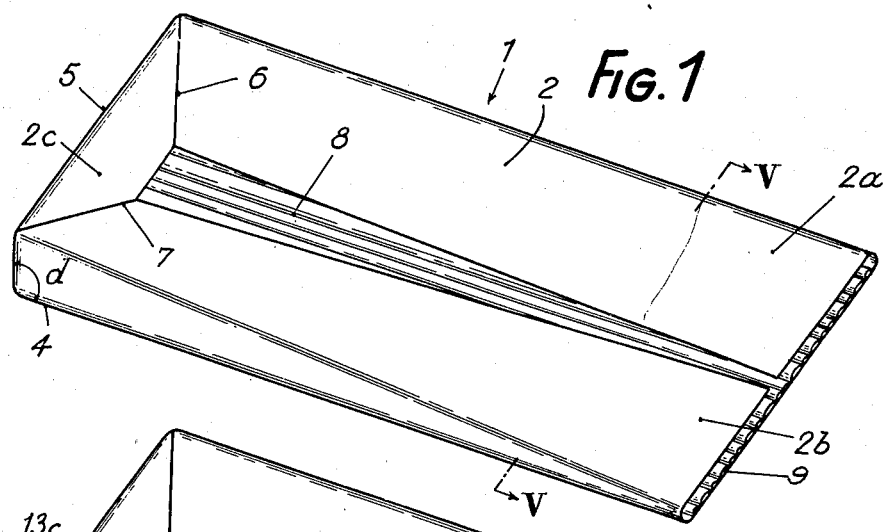
FIG. 1 is a perspective view of the underside of the cover of the present invention.

The cover forming a case is shown as a whole in FIG. 1 and is indicated by the general reference numeral 1. It comprises an upper piece 2 (FIGS. 1 and 5) of a material having good heat insulating properties and preferably characterised by a certain degree of elasticity and a lower piece 8.

Figure 5:
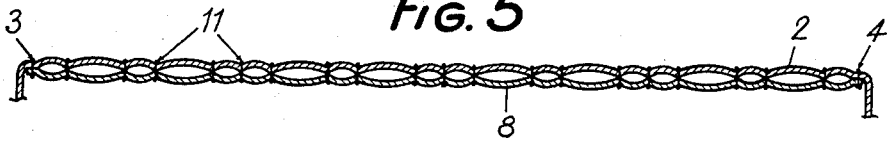
FIG. 5 is an enlarged view in section of a cover taken on the line V—V of FIG. 1 and after the turning back of the cover.

The piece 2 is cut so as to present flaps 2a, 2b and 2c defined by the respective stitches 3, 4 and 5, the stitches 3 and 4 being shown in FIG. 5 and the stitches 4 and 5 being shown in FIG. 1.

The seams 6 and 7 produce a slight longitudinal tension on the piece 2 making it possible to produce a case, the almost parallelopiped shape of which is shown in FIG. 5 by the production of the rounded portion *d* (shown in FIG. 1) formed by the line of stitches 4. Since no other seam is provided on the flaps 2a, and 2b, the ends opposed to the seams 6 and 7 fall freely onto the piece 8.

A rectangular portion, called the padded portion and best shown in FIG. 5, is defined by the stitches 3, 4, 5 and 9. Inserted between the two pieces 2 and 8, is a flexible material 10 having good heat insulating properties and the advantage of effecting, due to its natural resilience, the separation of the pieces 2 and 8. In order, on the one hand, to give the unit a padded appearance but without thereby losing the advantage resulting from the elasticity of the material and, on the other hand, in order to increase this elasticity even more, longitudinal stitches 11 are provided in the padded portion. These stitches are distributed at regular intervals across the width of the interface of pieces 2 and 8, disposed one upon the other without tension. These stitches militate against longitudinal extension or contraction of the flexible material 10, without meanwhile significantly affecting its elasticity in the lateral direction.

The result is that when the end of the cover forming a case is engaged on the mattress, the flaps 2*a* and 2*b* conform to the thickness of the mattress 12 (FIG. 3), without stretching the material.

Moreover, since no seam, other than the seams 6 and 7 are provided to define the rounded portion d, it is possible to cover, without excessive tension and without unnecessary folds, mattresses of different thicknesses, despite the longitudinal stitches preventing lengthwise stretching. These stitches themselves also have the advantage of preventing, in the event of any lateral extension, the coming together of the longitudinal ends, which would take place to some extent if the modulus of elasticity were uniform in all directions.

Thus a cover is obtained undeformable in the direction of its length, but capable of stretching transversely. By way of example, the cover may be made of padded polyamide mesh on a layer of polyester fibre.

Figure 2:
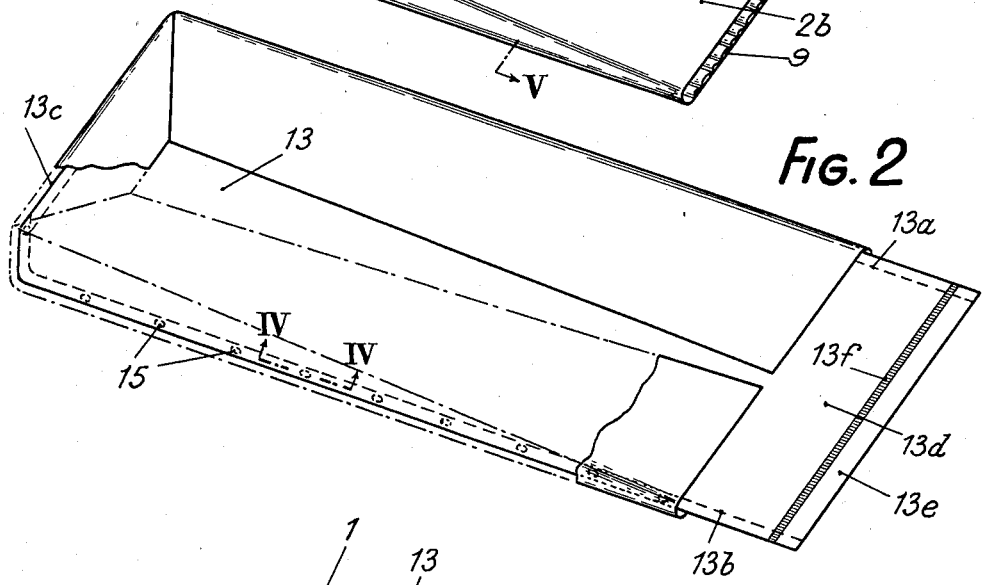
FIG. 2 is a perspective view, similar to that of FIG. 1, partially broken away, and after the attachment of the sheet.

The stitches 3, 4 and 5 comprise fasteners and preferably buttons sewn into the lines of the stitches in order to cooperate with the sheet 13, the cross measurement of which is reduced, but is preferably slightly more than that of the lower piece of material 8 of the cover. The length of the sheet is equal to that of the piece 8 increased by a length shown at 13*d* (FIG. 2).

Figure 4:
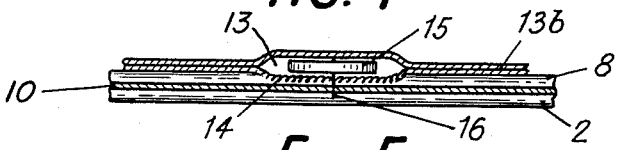
FIG. 4 is a fragmentary section taken on the line IV—IV of FIG. 2

This sheet is provided with hems 13*b* and 13*a* in which buttonholes 13 (FIG. 4) are formed, the slits of which are all preferably arranged in the direction of the stitches 11. The buttons 15, kept sewn in the stitching 4 by the threads 16, are therefore inside and in the plane of each of the hems 13*b* and 13*a*.

The sheet is also held in the stitches 5 by the hem 13*c* (FIG. 2), likewise comprising buttonholes arranged in the same direction as the stitches 11.

Since the cover cannot slip from the mattress on account of the case formed by the flaps 2*a*, 2*b*, and 2*c*, the sheets 13 can neither ride up nor slip transversely.

Figure 3:
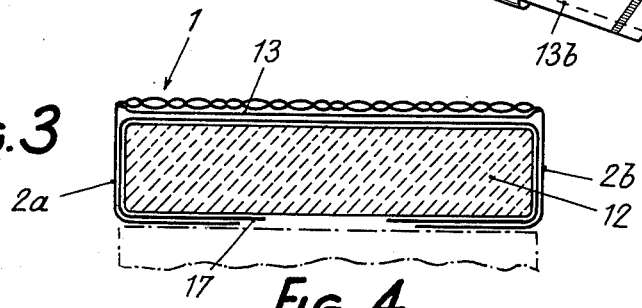
FIG. 3 is a schematic view of the cross-section of the cover and of its sheet in the position of use on a mattress.

It will be noted in FIG. 3 that, since the flaps 2*a* and 2*b* are formed only by a single thickness of material, the mattress 12 rests with its sides only on the thickness of the lower sheet 17 and the flaps 2*b* or 2*c*, thus avoiding the appreciable raising of the side portion of the mattress which occurs when ordinary blankets and sheets are used. At the same time, deformation of the centre portion of the mattress due to sinking is avoided.

The end 13*d* preferably terminates in a hem 13*e* the line of stitches of which may be masked by any known means, such as embroidery 13*f*, for example. The end 13*d* is turned down over the cover 1, thus hiding the hems 13*a* and 13*b*.

Although only one embodiment of the present invention is shown in the drawings, it is clear that many variations may be made without departing from the scope of the invention.

Thus, for example, the flaps 2*a* and 2*b* could also be padded or lined for a length equal to or less than the thickness of the mattress. Conversely, the padded portion need not finish at 5 but only at a space therefrom equal to the thickness of the mattress.

Similarly, the buttons 15 and the buttonholes 14 may be replaced by any other system of fastening: pressure means, plaiting, zip fasteners, clinging textile or the like closures.

As to the seams 6 and 7, they need not be in a straight line, according to the section of the flaps 2*a*, 2*b* and 2*c*. These flaps could also be attached pieces and, finally, the flap 2*c* could be omitted, the seams 6 and 7 then merging into the stitch 5. The seams 6 and 7 could also be replaced by zip fasteners.

It is obvious that the materials used could be of any type: natural, artificial, or synthetic textiles, which also applies to the part 10, and the stitches 11 could be omitted or replaced by others, the part 10 being kept in position by any other means. However, according to a preferred embodiment of the present invention, the materials are polyamide mesh with a velvet effect and, according to a feature of the present invention, the polyamide - or preferably polyester - filling 10 is a layer having a maximum elasticity in one direction and very slight elasticity in the direction perpendicular thereto, the said layer being disposed between the fabrics so that the lines of longitudinal stitches on the cover are perpendicular to its direction of maximum elasticity.

The advantages associated with this variant are numerous. One of these advantages is to allow the material to adhere to the sheet, and to use the envelope cover as a bedspread when the seams 6 and 7 coincide with the stitching 5 and are replaced by zip fasteners. In fact, during the period when the bed is not in use, it is only necessary to free the flaps 2*a* and 2*b* by undoing the closures in order to allow the flaps to hang down the side parts of the mattress, then to close the closures again to use the bedspread once more as a cover. It will be noted that, by allowing the flaps to fall over the edges of the mattress, it is possible to stretch out the cover, the flaps of which adhere to the side parts of the mattress and the base and that, by virtue of the large lateral extension of the cover, due to the combination of the longitudinal stitches and the direction of elasticity of the filling layer, it is possible to cover over the thickness of the mattress and the base, even if the sum of their thickness is greater than the natural length of the flaps, without thereby definitely spoiling the shape of the cover. On account of the great elasticity of the material, the cover resumes its original shape as soon as contact of the flaps with the side parts of the mattress and the base is eliminated.

Finally the material allows of great improvement in heat insulating properties, since the velvet mesh effect seals up a considerable layer of air between itself and the sheet.

This effect may be even further reinforced by introducing between the cover and the sheet a padded removable plate which may or may not comprise a system of fasteners similar to that of the sheet: a simple buttonhole, for example superimposing itself on that of the sheet. The systems of fasteners may be secured to the inner edges of the flaps 2*a* and 2*b*, particularly if the padded part extends to the edge of these flaps.

To sum up, the cover of the present invention presents, by the combination of the means it employs, unequalled features of lightness, elasticity, heat insulation, comfort and convenience in manufacture and use, whilst having a moderate cost price. In particular, it yields a substantial result: the preservation of a neat, tucked-in bed during the course of its use, which could not be achieved with the use of conventional coverings or eiderdowns, since any movement by the user displacing the cover would first involve the pulling out of the side edges of the cover from its position between the mattress and the base, then, if such movements are repeated, the uncovering of the person. Due to its considerable lateral elasticity, the new cover prevents any withdrawal of the sides of the cover out of the recessed position formed by the surfaces in contact with the mattress and the base and, in addition, automatically re-establishes contact with the user, which would evidently not be the case with previous covers and eiderdowns.

What I claim is:

1. An envelope cover for a mattress comprising:

1. rectangular padded portion the dimensions of which are approximately equal to those of the upper surface of the mattress to be covered, said rectangular padded portion comprising an upper material and a lower material between which there is disposed an elastic filling of high thermal insulating properties, said upper and lower materials being stitched together along a plurality of lines parallel to their long sides, thereby permitting said rectangular padded portion to be stretched in the direction parallel to its short sides, but substantially preventing it from being stretched in the direction parallel to its long sides;

2. two long flaps, one associated with each of the long sides of said rectangular padded portion; and
3. one short flap, associated with one of the short sides of said rectangular padded portion and attached to said two long flaps along the two interfaces therebetween, whereby said rectangular padded portion and the three flaps form a rectangular open case which is elastic in the direction parallel to the short sides thereof, but substantially inelastic in the direction parallel to the long sides thereof.

2. An envelope cover for a mattress as claimed in claim 1 wherein at least said upper material is likewise elastic, thereby facilitating a still greater degree of stretching of said rectangular portion in the direction parallel to its short sides.

3. An envelope cover for a mattress as claimed in claim 1 wherein said flaps are extensions of said upper material.

4. An envelope cover for a mattress as claimed in claim 1 wherein said rectangular portion is made of padded polyamide on a layer of polyester fibers.

5. An envelope cover for a mattress as claimed in claim 1 and further comprising a sheet removably attached to the underside of said rectangular padded portion.

* * * * *